US006181078B1

(12) United States Patent
Sekiguchi et al.

(10) Patent No.: US 6,181,078 B1
(45) Date of Patent: Jan. 30, 2001

(54) DISCHARGE LAMP LIGHTING SYSTEM

(75) Inventors: Masao Sekiguchi; Teruo Tamura, both of Tokyo (JP)

(73) Assignee: Kabushiki Kaisha Tamurariken, Tokyo (JP)

( * ) Notice: Under 35 U.S.C. 154(b), the term of this patent shall be extended for 0 days.

(21) Appl. No.: 09/377,712

(22) Filed: Aug. 20, 1999

(30) Foreign Application Priority Data

Aug. 25, 1998 (JP) ..... 10-239216

(51) Int. Cl.[7] ..... H05B 37/00
(52) U.S. Cl. ..... 315/242; 315/243
(58) Field of Search ..... 315/242, 243, 315/240, 234, 94, 107, 105, 106, 62

(56) References Cited

U.S. PATENT DOCUMENTS

| | | | | |
|---|---|---|---|---|
| 3,705,329 | * | 12/1972 | Vogeli | 315/103 |
| 3,836,816 | * | 9/1974 | Heck | 315/94 |
| 4,274,084 | * | 6/1981 | Haus | 340/326 |
| 4,885,507 | * | 12/1989 | Ham | 315/244 |
| 4,914,354 | * | 4/1990 | Hammer et al. | 315/247 |
| 4,996,463 | * | 2/1991 | Horowitz | 315/250 |
| 5,179,323 | * | 1/1993 | Ham | 315/239 |
| 5,349,270 | * | 9/1994 | Roll et al. | 315/209 R |
| 5,359,263 | * | 10/1994 | Roberts | 315/58 |
| 5,412,286 | * | 5/1995 | Kazi et al. | 315/242 |
| 5,532,553 | * | 7/1996 | Flory, IV | 315/169.3 |
| 5,736,817 | * | 4/1998 | Rothenbuhler et al. | 315/106 |
| 5,962,988 | * | 10/1999 | Nuckolls et al. | 315/291 |
| 6,028,399 | * | 2/2000 | Moisin | 315/224 |

FOREIGN PATENT DOCUMENTS

| | | |
|---|---|---|
| 28-1180 | 2/1953 | (JP) . |
| 32-10781 | 12/1957 | (JP) . |
| 33-7743 | 9/1958 | (JP) . |
| 50-27362 | 3/1975 | (JP) . |
| 52-18076 | 2/1977 | (JP) . |
| 53-27280 | 3/1978 | (JP) . |
| 55-171999 | 5/1980 | (JP) . |
| 57-36697 | 2/1982 | (JP) . |

* cited by examiner

*Primary Examiner*—David Vu
*Assistant Examiner*—Trinh Vo Dinh
(74) *Attorney, Agent, or Firm*—Oliff & Berridge, PLC

(57) ABSTRACT

The present invention provides a discharge lamp lighting system in which a discharge lamp is lighted by a commercial power source without using a choke transformer, electric power can be saved, and, in order to prevent a bad influence of high harmonic waves generated from the discharge lamp upon other electronic equipment, the impedance ratio resonating with the third high harmonic wave component of the power source is established between a capacitor and a choke coil provided between the discharge lamp and an alternate current power source to facilitate resonance of the third high harmonic wave component, and, when a starting lighting circuit is temporarily turned ON, the discharge lamp is lighted.

8 Claims, 12 Drawing Sheets

DISCHARGE VOLTAGE WAVE FORM IN DISCHARGE SYSTEM OF FIG. 1

DISCHARGE VOLTAGE WAVE FORM IN DISCHARGE SYSTEM OF FIG. 4

DISCHARGE LAMP LIGHTING SYSTEM

BACKGROUND OF THE INVENTION

1. Field of the Invention

The present invention relates to an improvement in a discharge lamp lighting system for lighting a discharge lamp such as a discharge mercury lamp, a sodium vapor lamp, a fluorescent lamp and the like.

2. Description of the Related Art

Discharge mercury lamps have been used on highways and in factories, sodium vapor lamps have been used in tunnels, and fluorescent lamps have widely been used in homes, offices, factories, hospitals and the like. Various lighting device for such discharge mercury lamp, sodium vapor lamp and fluorescent lamp (referred to generically as "discharge lamp" hereinafter) have been proposed, and all of these devices utilize a choke transformer for exclusively effecting "lighting".

PROBLEMS IN THE PRIOR ART

1. Since the conventional lighting device utilizes the choke transformer, due to iron loss or copper loss of the transformer, great energy is lost. Thus, brightness of the lamp is insufficient in comparison with great power consumption.
2. Current flowing through the discharge lamp includes disturbed high harmonic wave peak current component (high harmonic noise current), and since such high harmonic noise current flows into a power circuit for the discharge lamp, noise and/or radio-fault is generated in various equipment (for example, electronic life maintaining devices in hospitals, computers or the like) having such a power source as a common power source, which may result in erroneous operation of the equipment. This is a serious problem. Particularly, if the electronic life maintaining device is erroneously operated, serious accident affecting human life will happen Further, electromagnetic wave generated from the discharge lamp affects a bad influence upon other equipment. Nowadays, the above-mentioned drawbacks have not been solved.

SUMMARY OF THE INVENTION

An object of the present invention is to realize a discharge lamp lighting system in which a discharge lamp can be lighted by a commercial power source without using a power source transformer, lighting can be continued, energy loss is less, brightness corresponding to power consumption can be obtained efficiently, great electric power saving can be realized, and a high harmonic wave generated by the discharge lamp can be prevented from affecting a bad influence upon other electronic equipment.

To achieve the above object, the present invention provides a discharge lamp lighting system wherein one end of a discharge lamp is connected to one end of an alternate current (AC) power source through a capacitor and the other end of the discharge lamp is connected to the other end of the AC power source through a choke coil in such a manner that an impedance ratio resonating with a third high harmonic wave component of the power source is established between the capacitor and the choke coil, and a starting lighting circuit which is normally turned OFF and can be temporarily turned ON to light the discharge lamp is connected between filaments disposed at both ends of the discharge lamp.

The present invention further provides a discharge lamp lighting system wherein one end of a discharge lamp is connected to one end of an alternate current (AC) power source and the other end of the discharge lamp is connected to the other end of the AC power source through a capacitor and a choke coil which are interconnected in series in such a manner that an impedance ratio resonating with a third high harmonic wave component of the power source is established between the capacitor and the choke coil, and a starting lighting circuit which is normally turned OFF and can be temporarily turned ON to light the discharge lamp is connected between filaments disposed at both ends of the discharge lamp.

The present invention still further provides a discharge lamp lighting system wherein one end of a discharge lamp is connected to one end of an alternate current (AC) power source through a capacitor and a choke coil which are interconnected in series and the other end of the discharge lamp is connected to the other end of the AC power source through another choke coil in such a manner that an impedance ratio resonating with a third high harmonic wave component of the power source is established between the capacitor and the choke coil and a starting lighting circuit which is normally turned OFF and can be temporarily turned ON to light the discharge lamp is connected between filaments disposed at both ends of the discharge lamp.

According to the present invention, since the impedance ratio resonating with the third high harmonic wave component of the power source is established between the capacitor and the choke coil to facilitate resonance of the third high harmonic wave component, when the starting lighting circuit is temporarily closed, a closed circuit serially interconnecting the AC power source, choke coil, filament, switch, filament, switch, capacitor and AC power source is established. When power source voltage having a wave form (wave form shown in FIG. 9) including third high harmonic waves is applied to the closed circuit through a device having an iron core to energize the closed circuit, first of all, the filaments on both ends of the discharge lamp are heated, and, at the same time, a voltage wave form of the choke coil becomes to include third high harmonic wave as shown in FIG. 10 and a voltage wave form of the capacitor is also changed as shown in FIG. 11. In this case, since the filaments on both ends of the discharge lamp were heated to initiate thermal electron emission, when the starting lighting circuit is opened, the fluorescent lamp can easily be lighted by releasing the energy accumulated in the capacitor. When the fluorescent lamp starts to be lighted after the starting lighting circuit is opened, a voltage wave form at the end of the choke coil becomes as shown in FIG. 12. As apparent from the comparison with the power source wave form shown in FIG. 9, this voltage wave form includes the third high harmonic waves and a wave form inherent to discharging. Further, in this case, a discharge voltage wave form at both ends of the discharge lamp becomes a wave form corresponding to a basic wave form of the power source as shown in FIG. 13. In the discharge lamp lighting system according to the present invention, since an effective resistance value of the entire circuit becomes extremely small as is in a principle of a super-regenerative receiver circuit, the lighting current can continue to be applied efficiently. In this discharge lamp system, regarding power consumption of a tube bulb and fill luminous flux value, formula effect of 100 lm (lumen)/(w or more can be obtained.

DETAILED DESCRIPTION OF THE PREFERRED EMBODIMENTS

First Embodiment

Figure 1:
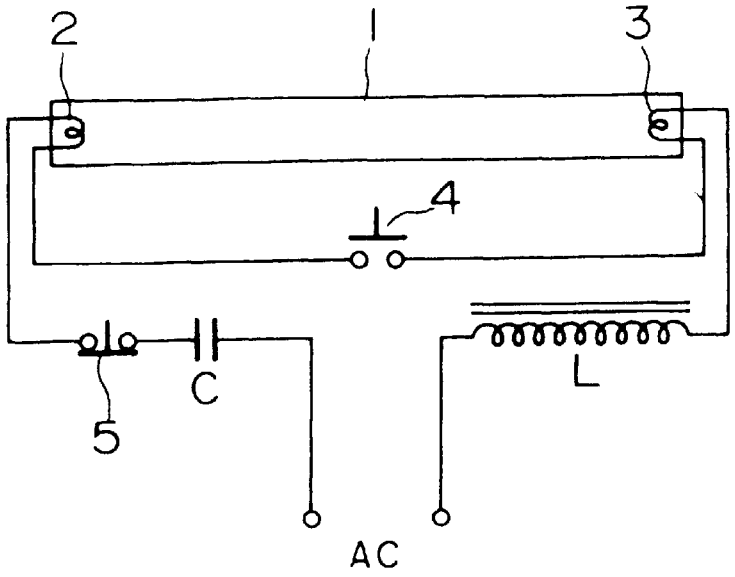
FIG. 1 is a circuit diagram of a discharge lamp lighting system according to a first embodiment of the present invention.

First of all a discharge lamp lighting system according to a first embodiment of the present invention will be described with reference to FIG. 1. In the system shown in FIG. 1, a discharge lamp 1 comprises a fluorescent lamp of rapid start type. In this lighting system, a choke transformer, which was used in conventional lighting devices is not used, and, a filament 2 disposed at one end of the discharge lamp 1 is connected to an alternate current (AC) power source through a capacitor C, a filament 3 disposed at the other end of the discharge lamp is connected to the AC power source through a choke coil L, a starting lighting circuit (for example, a switch; A contact) 4 which is normally turned OFF is connected between the filaments 2 and 3, and an extinguishing switch 5 which is normally turned ON is connected at one end of the AC power source.

When the starting lighting circuit (switch) 4 shown in FIG. 1 is manually turned ON, a closed circuit serially interconnecting the AC power source AC, capacitor C, filament 2 of the discharge lamp 1, switch 4, filament 3 of the discharge lamp 1, choke coil L, and AC power source AC is established. While such a closed circuit is being established, the filaments 2, 3 are energized to be heated, thereby starting thermal electron emission. At the same time, energy is accumulated in the capacitor C and the choke coil L. When the switch 4 is turned OFF after the switch 4 was depressed for 0.1 to 0.5 second, discharge is started between the previously heated filaments 2 and 3, and energy previously accumulated in the capacitor C and the choke coil L is radiated to apply voltage (about 180 to 200 Volts when AC power source is 100 Volts) required for initiation of discharging between the filaments 2 and 3, thereby lighting the discharge lamp 1.

Figure 6A:
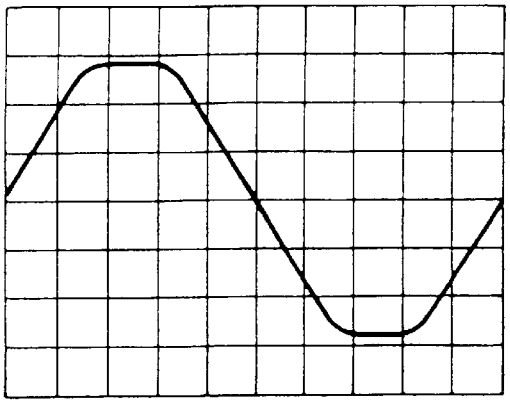
FIG. 6A is a view showing a wave form of AC input voltage in FIGS. 1 to 4.
Figure 6B:
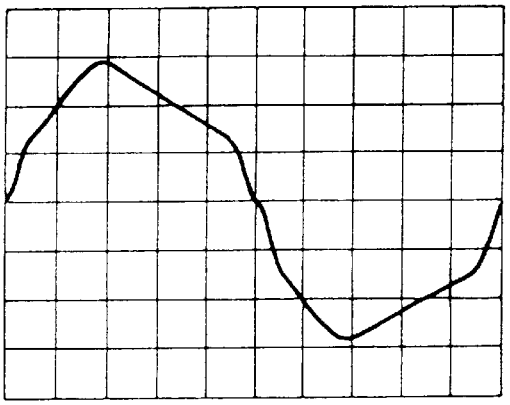
FIG. 6B is a view showing a wave form of discharge voltage of a discharge lamp in the discharge lamp lighting system shown in FIGS. 1 to 3.

In the lighting system according to the present invention, when the discharge lamp 1 is lighted, although accumulation and radiation of energy regarding the capacitor C and the choke coil L are repeated every half wave of the input AC power source, since the charging and discharging operations have phase difference of 90 degrees, the charging and discharging current accumulated and saturated in the capacitor C and the choke coil L flows into the discharge lamp 1 when commercial input sine wave reaches a zero value, thereby effecting light emission. Thus, by appropriately selecting constants of the capacitor C and the choke coil L, flicker inherent to the fluorescent lamp can be prevented to substantially eliminate flickering of the fluorescent lamp. Further, since light emitting current is given when commercial power source wave reaches a zero value, the light increasing effect is achieved to increase brightness of the fluorescent lamp. In addition, comparing input electric power and full luminous flux, energy saving effect of several tens of percents can be achieved in comparison with a conventional fluorescent lamp lighting apparatus. As a result of tests, in the discharge system of FIG. 1, it was found that, when an input voltage wave form of the AC power source is as shown in FIG. 6A, a discharge wave form of the discharge lamp 1 is widened as shown in FIG. 6B to improve the light increasing effect.

In the discharge lamp lighting system of FIG. 4, when a double-lighting discharge lamp of 40 Watts was used with a power source of 200 Volts under rated discharge current, a test result shown in the following Table 1 was obtained.

TABLE 1

| | | |
|---|---|---|
| Input | voltage | 210.1 V |
| | current | 0.404 A |
| | V · A | 85.0 VA |
| | electric power W | 57.2 W |
| Tube bulb | voltage | 92.3 V |
| | current | 0.404 A |
| | V · A | 37.289 VA |
| | V · Ao(× 2) | 74.578 VAo |
| Illumination | lux | 1400 (distance of 480 mm from object) |
| Efficiency | versus input VA | $\eta$ = 88% |
| | versus input W | $\eta$ = 131% |

When the discharge lamp 1 of FIG. 1 is lighted, since current flows due to specific resistance of the choke coil L, heat loss occurs. In this case, however, when it is assumed that discharge current is 0.36 A (normal) and specific resistance is 30 Ω, heat loss is merely about 4 Watts, which is considerably small in comparison with heat loss in the conventional stabilizer, thereby achieving great energy saving.

When the discharge lamp 1 so lighted is extinguished or turned OFF, extinguishing switch 5 may be merely turned OFF. As a result, power supply from the AC power source to the filaments 2, 3 is interrupted to extinguish the discharge lamp 1.

Figure 5:
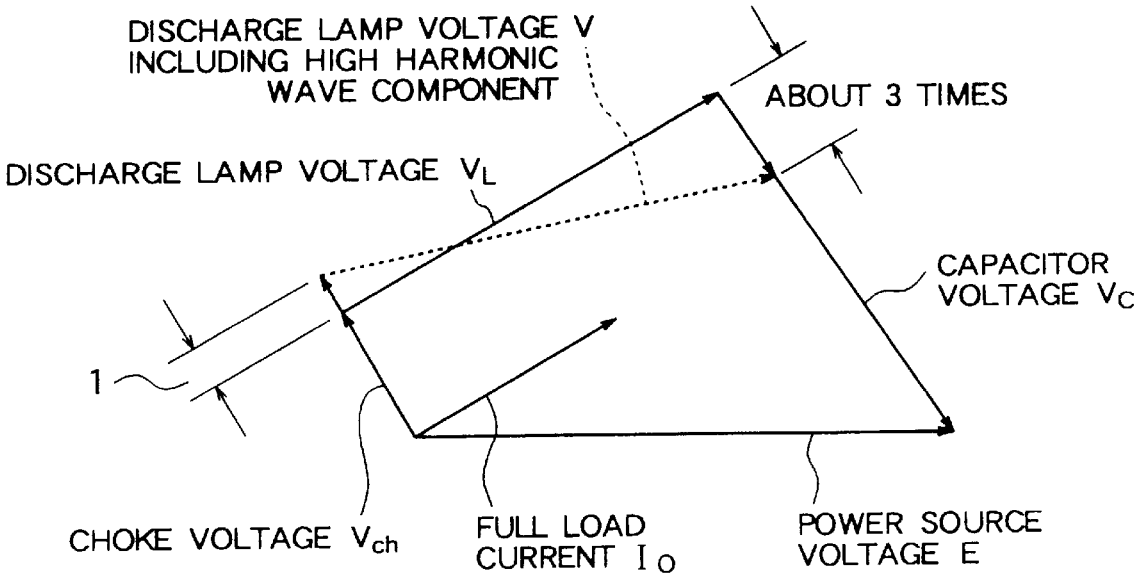
FIG. 5 is a vector diagram for explaining an operation of the discharge lamp lighting system of the present invention.

In FIG. 1, since the choke coil (induction reactance) L and the capacitor (capacitive reactance) C are provided, regarding the third high harmonic wave component generated by the magnetic history effect of the choke of the choke coil, as shown in FIG. 5, a vector of choke voltage $V_{ch}$ is increased to a value corresponding to the number of the high harmonic wave (induction reactance: 2 π fC three times), and, conversely, a vector of capacitor voltage $V_c$, is decreased to a value corresponding to a reciprocal of the number of the high harmonic wave (capacitive reactance: ½π fC: ⅓), with the result that voltage V of the discharge lamp including the high harmonic wave component is increased, as shown by the broken line in FIG. 5. In this case, since there is a relationship that if the discharge voltage is increased the discharge current is decreased, when the discharge lamp voltage V including the high harmonic wave component is increased, the discharge current including the high harmonic wave component is decreased. That is to say, when a discharge phenomenon (disturbed noise current) based on the third high harmonic wave component generated, since the discharge end voltage is increased by the action of the choke coil L and the capacitor C, stability of discharge property is lost to disappear the disturbed current component. Incidentally, most of the third high harmonic wave component flowing-in from the power source is absorbed and eliminated by the resonating circuit constituted by the choke coil L and the capacitor C, thereby preventing disturbed current which may generate external noise. Further, since the induction reactance and the capacitive reactance are simultaneously functioned, effect of such action is achieved at a speed faster, by a square, than that in the induction reactance alone or the capacitive reactance alone. Thus, in the present invention, noise and/or fault radio wave generated at both ends of the discharge lamp 1 are isolated from the power source.

Further, in FIG. 1, fault waves created on the basis of the third high harmonic wave component generated at both ends of the discharge lamp 1 are absorbed by the resonating circuit including the choke coil L, AC power source (substantially zero impedance) and capacitor C, so that fault waves based on the third high harmonic wave causing dynamic current are absorbed and eliminated, thereby also eliminating higher order fault waves attendant on the third high harmonic waves. Particularly, by selecting the inductance of the choke coil L to an impedance value resonating with the third high harmonic wave component (for example, by selecting an impedance ratio between the choke coil L and the capacitor C to about 1:2~3), the fault waves created on the basis of the third high harmonic wave component generated at both ends of the discharge lamp 1 are absorbed by the resonating circuit efficiently, thereby eliminating the higher order fault waves attendant on the third high harmonic waves more efficiently.

Second Embodiment

Figure 2:
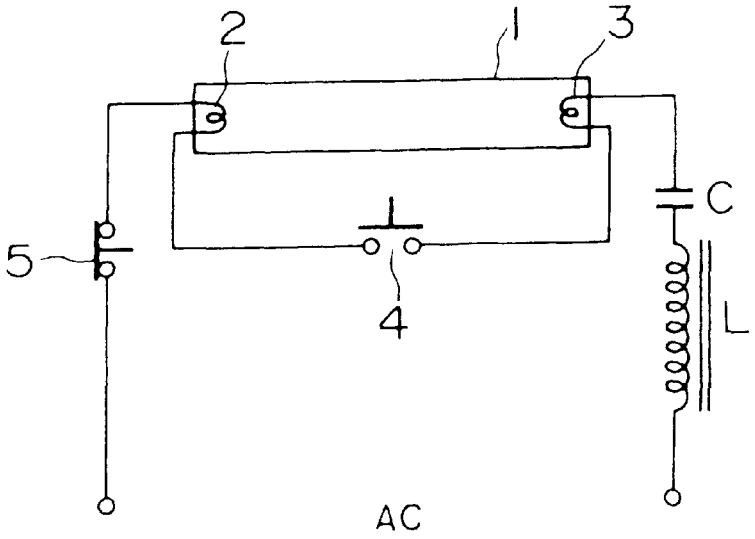
FIG. 2 is a circuit diagram of a discharge lamp lighting system according to a second embodiment of the present invention.

FIG. 2 shows a discharge lamp lighting system according to a second embodiment of the present invention In this lighting system, the capacitor C is connected to one end of the discharge lamp (fluorescent lamp) 1 and the choke coil L is connected to the capacitor C in series. In this case, when the starting lighting circuit (switch) 4 is manually turned ON, a closed circuit serially interconnecting an AC power source AC, discharge lamp 1, capacitor C, choke coil L and AC power source AC is established, thereby lighting the discharge lamp 1 as is in the first embodiment. On the other hand, when the extinguishing switch 5 is depressed to be turned OFF, power supply from the AC power source AC to the filaments 2, 3 is interrupted to extinguish the discharge lamp 1. In FIG. 2, it is difficult to eliminate a bad influence of the third high harmonic wave component and higher order fault waves attendant on such component.

Third Embodiment

Figure 3:
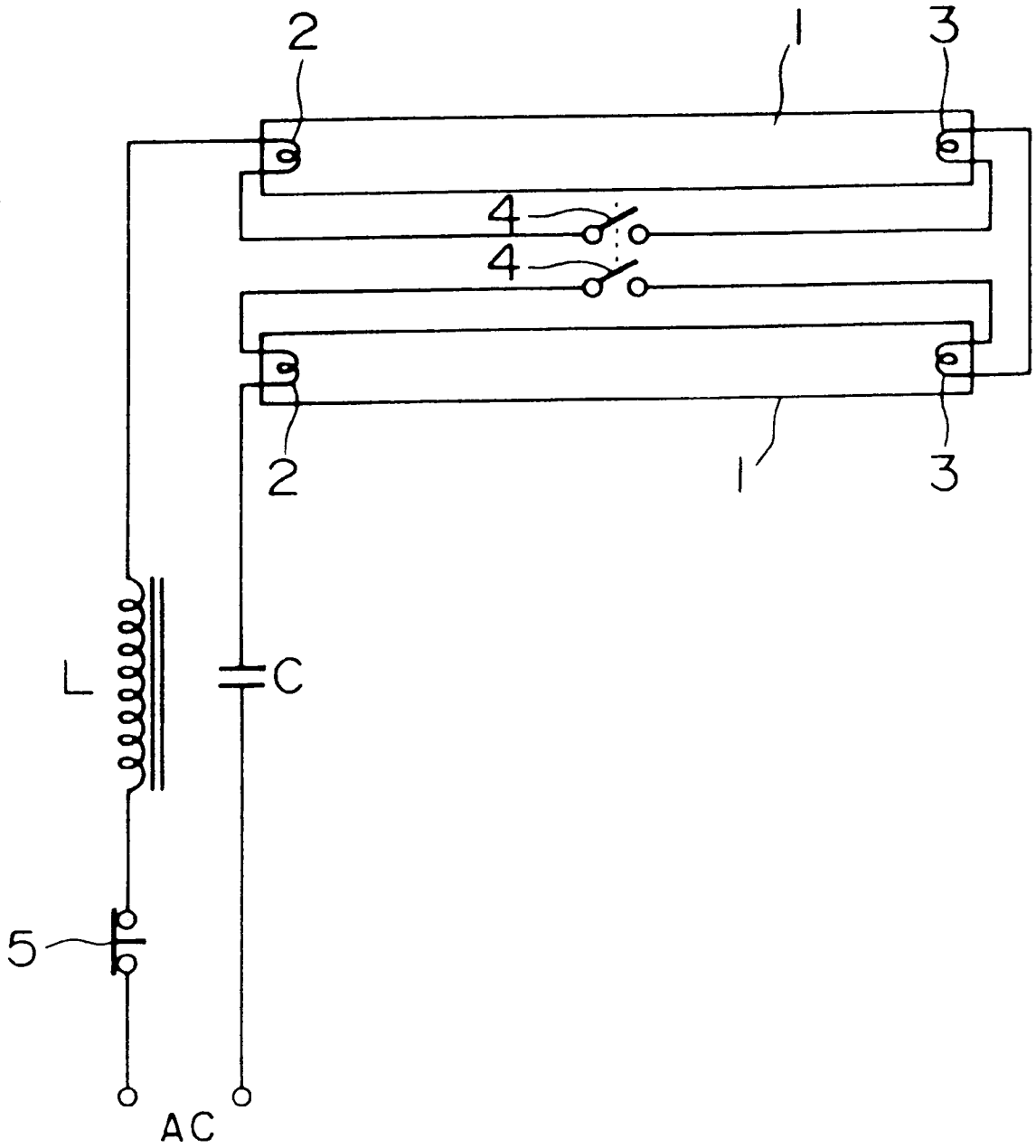
FIG. 3 is a circuit diagram of a discharge lamp lighting system according to a third embodiment of the present invention.

FIG. 3 shows a discharge lamp lighting system according to a third embodiment of the present invention. In this lighting system, two discharge lamps (fluorescent Lamps) 1 are connected in series and two starting lighting circuits (switches) 4 are operated in synchronous with each other. In FIG. 3, when the switches 4 are manually turned ON, a closed circuit serially interconnecting an AC power source AC, discharge lamp 1, capacitor C, choke coil L and AC power source AC is established, thereby lighting two discharge lamps 1 simultaneously. On the other hand, when the extinguishing switch 5 is depressed to be turned OFF, power supply from the AC power source AC to the filaments 2, 3 is interrupted to extinguish two discharge lamps 1 simultaneously. In FIG. 3, as is in FIG. 1, the third high harmonic wave component and higher order fault waves attendant on such component can be eliminated efficiently. In FIG. 4, an impedance ratio between the choke coil ($L+L_2$) and the capacitor C is selected to about 1:2~3.

Fourth Embodiment

Figure 4:
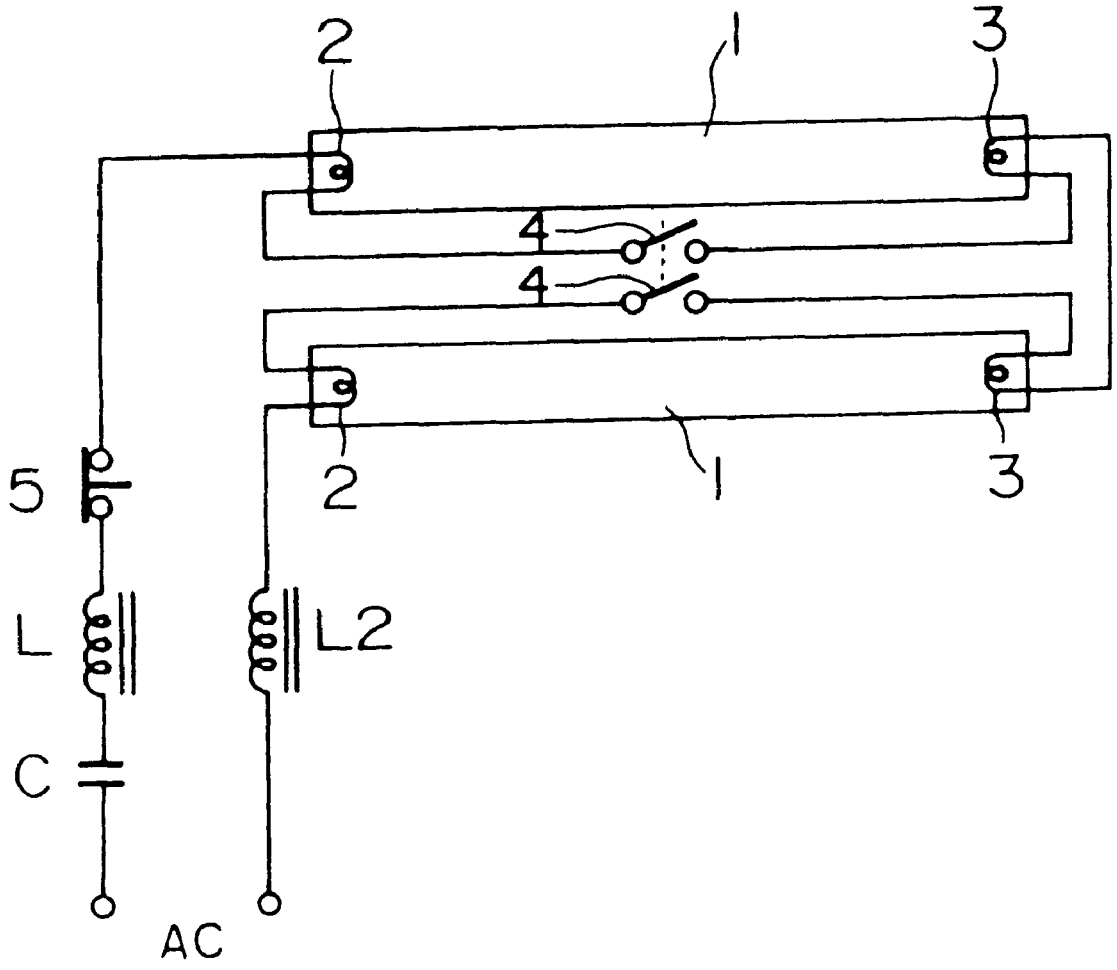
FIG. 4 is a circuit diagram of a discharge lamp lighting system according to a fourth embodiment of the present invention.
Figure 6C:
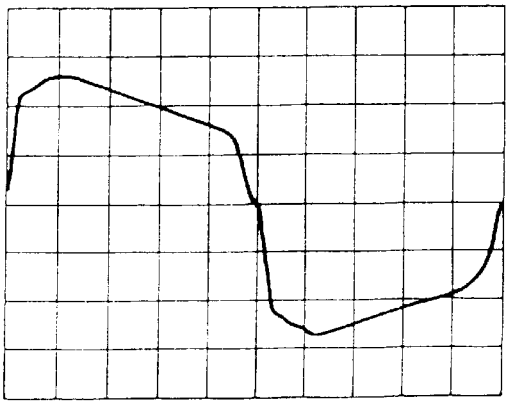
FIG. 6C is a view showing a wave form of discharge voltage of a discharge lamp in the discharge lamp lighting system shown in FIG. 4.

FIG. 4 shows a discharge lamp lighting system according to a fourth embodiment of the present invention In this lighting system, two discharge lamps (fluorescent lamps) 1 are connected in series and two starting lighting circuits (switches) 4 are operated in synchronous with each other. Further, one end of one of two discharge lamps 1 is connected to one end of the AC power source AC through a capacitor C and a choke coil L which are interconnected in series, and one end of the other discharge lamp 1 is connected to the other end of the AC power source AC through a choke coil $L_2$. In this case, when the input voltage wave form of the AC power source is as shown in FIG. 6A, discharge wave form of each discharge lamp 1 is widened as shown in FIG. 6C. As a result that, it was found that light increasing effect is improved by about 30 percents. Also in FIG. 4, as is in FIG. 1, the third high harmonic wave component and higher order fault waves attendant on such component can be eliminated efficiently.

Fifth Embodiment

Figure 7:
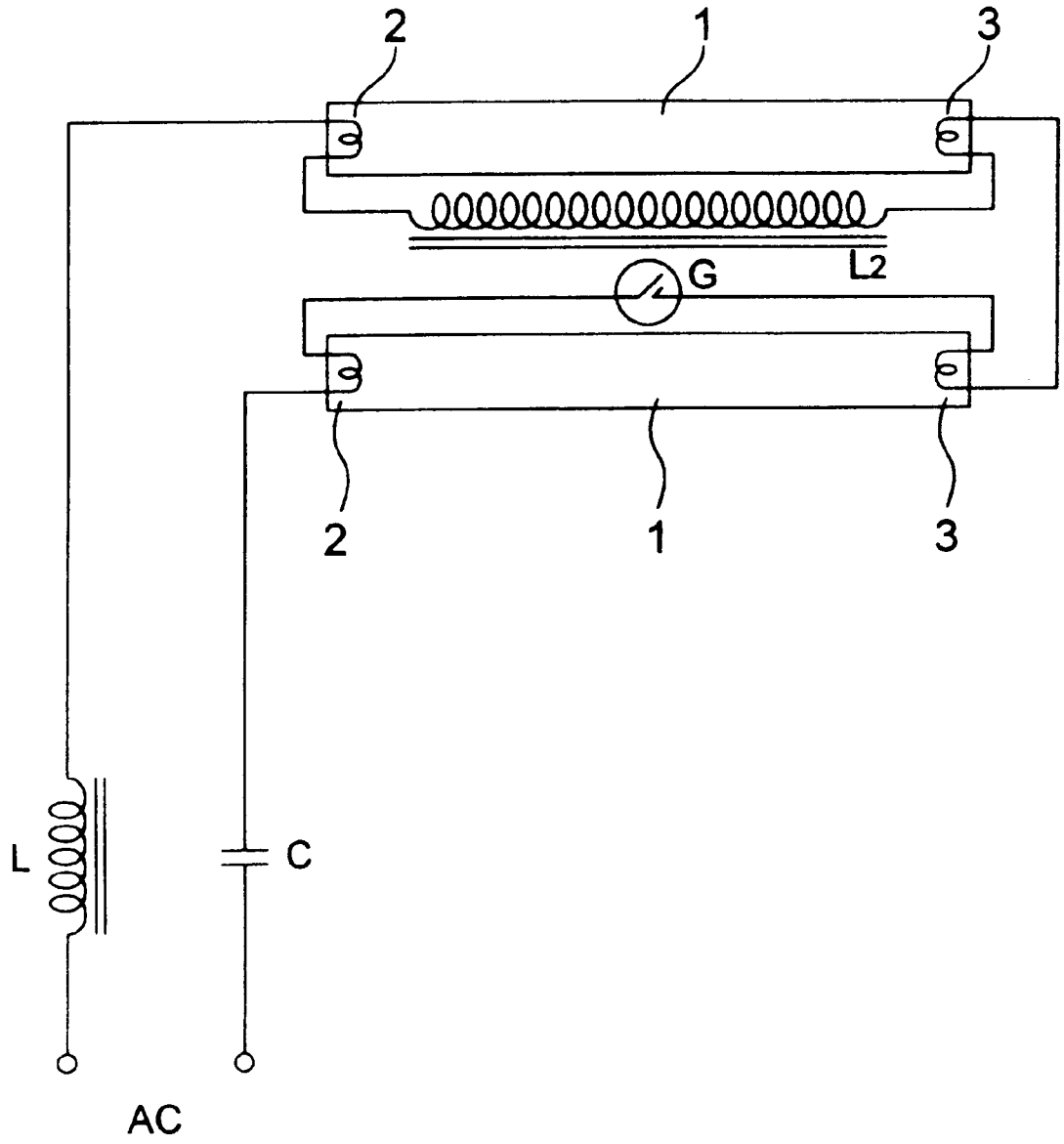
FIG. 7 is a circuit diagram of a discharge lamp lighting system according to a fifth embodiment of the present invention.

A discharge lamp lighting system according to another embodiment of the present invention is shown in FIG. 7. In this embodiment, a starting lighting circuit is constituted by a glow lamp G and an auxiliary choke coil $L_2$. In this discharge lamp lighting system, when the glow lamp G is operated, a circuit including an AC power source AC, capacitor C, filament 2, glow lamp G, filament 3, filament 3 of next fluorescent lamp 1, auxiliary choke coil $L_2$, filament 2 and choke coil L is established. The filaments 2, 3 are heated by current flowing this circuit, and, at the same time, the choke coils $L+L_2$ and the capacitor C are resonated to increase voltage at both ends of the auxiliary choke coil $L_2$, thereby lighting the upper fluorescent lamp 1 in FIG. 7. At this moment, the lower fluorescent lamp 1 in FIG. 7 is also lighted by the power source voltage. As a result, voltage of the ends of the fluorescent lamps 1 is decreased to stop glow discharge of the glow lamp G, thereby continuing the lighting of the fluorescent lamps 1.

Sixth Embodiment

Figure 8:
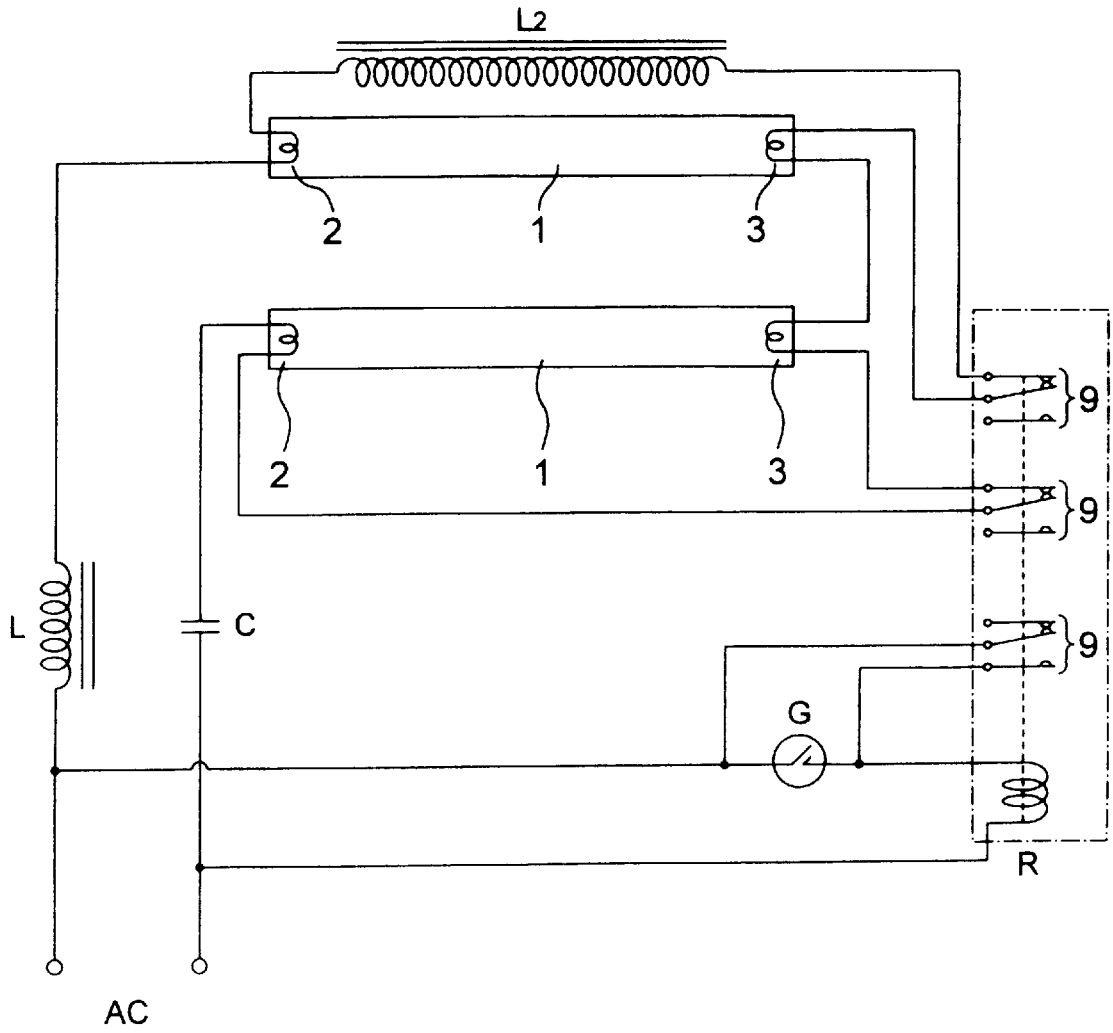
FIG. 8 is a circuit diagram of a discharge lamp lighting system according to a sixth embodiment of the present invention.
Figure 9:
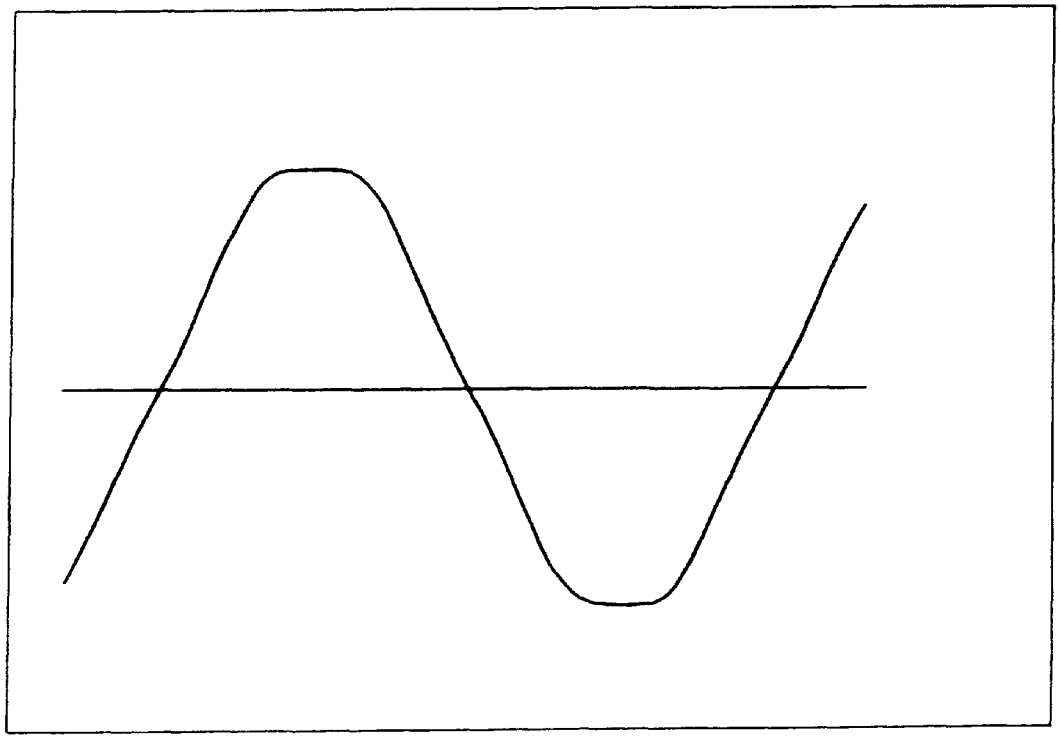
FIG. 9 is a view showing a wave form of power source voltage including third high harmonic wave.
Figure 10:
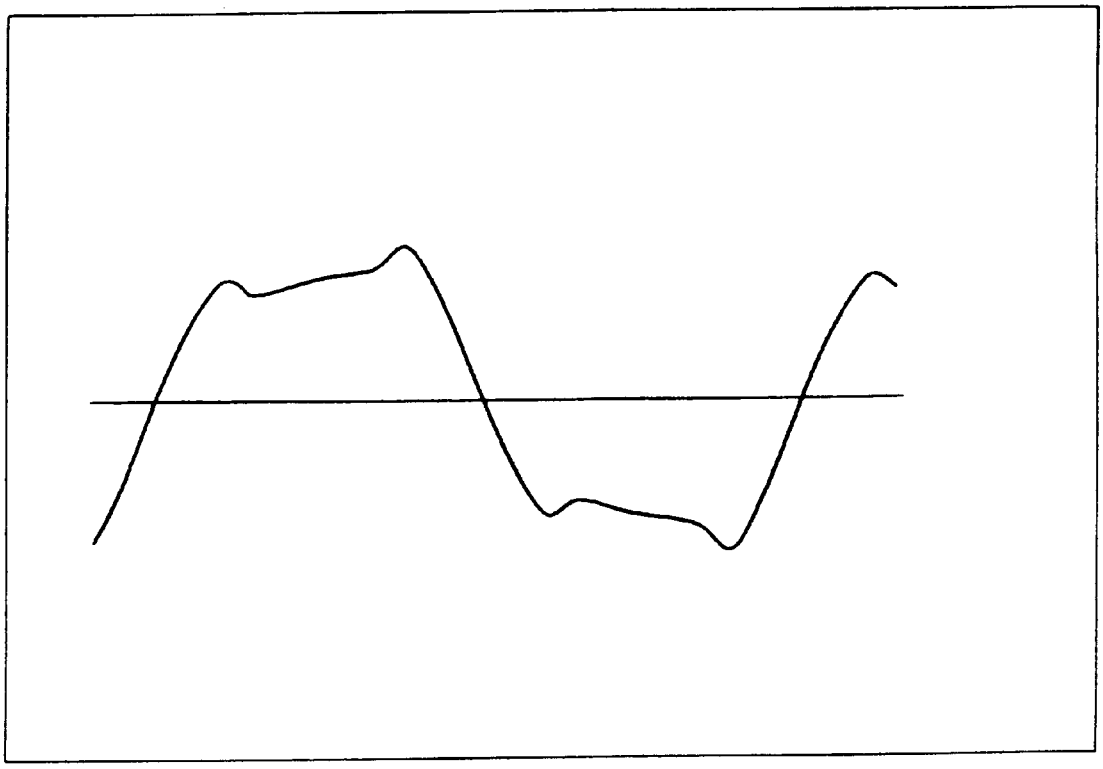
FIG. 10 is a view showing a wave form of voltage of a choke coil.
Figure 11:
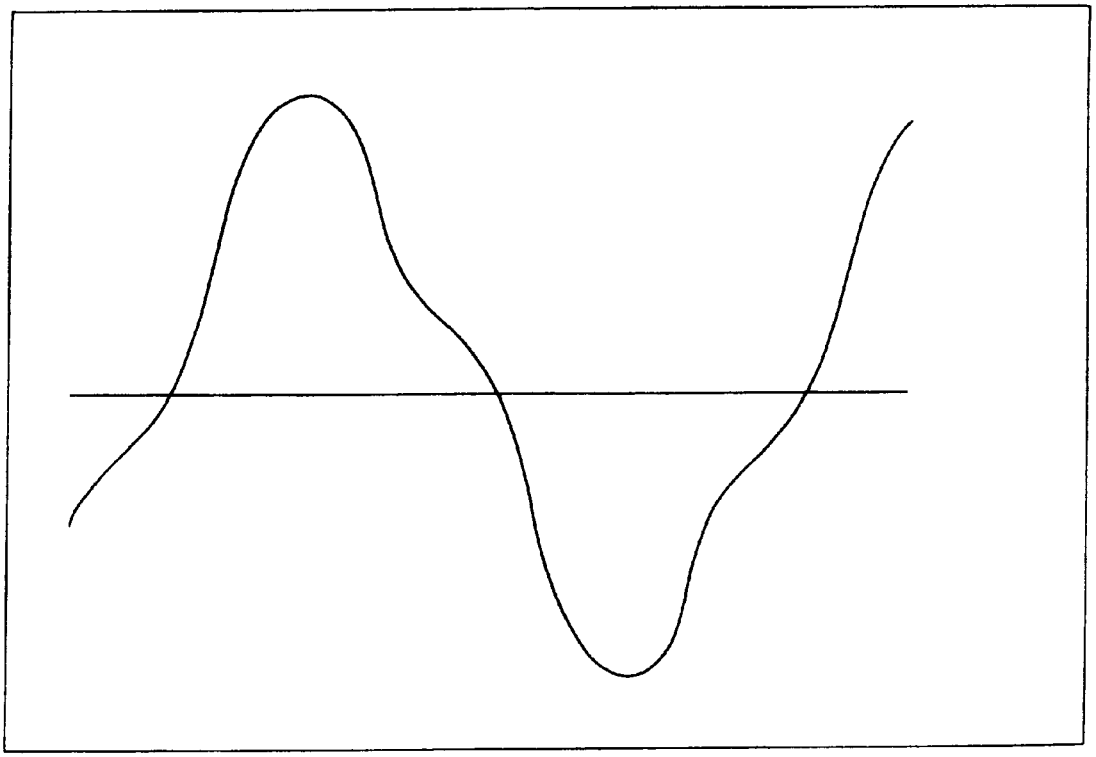
FIG. 11 is a view showing a wave form of voltage of a capacitor.
Figure 12:
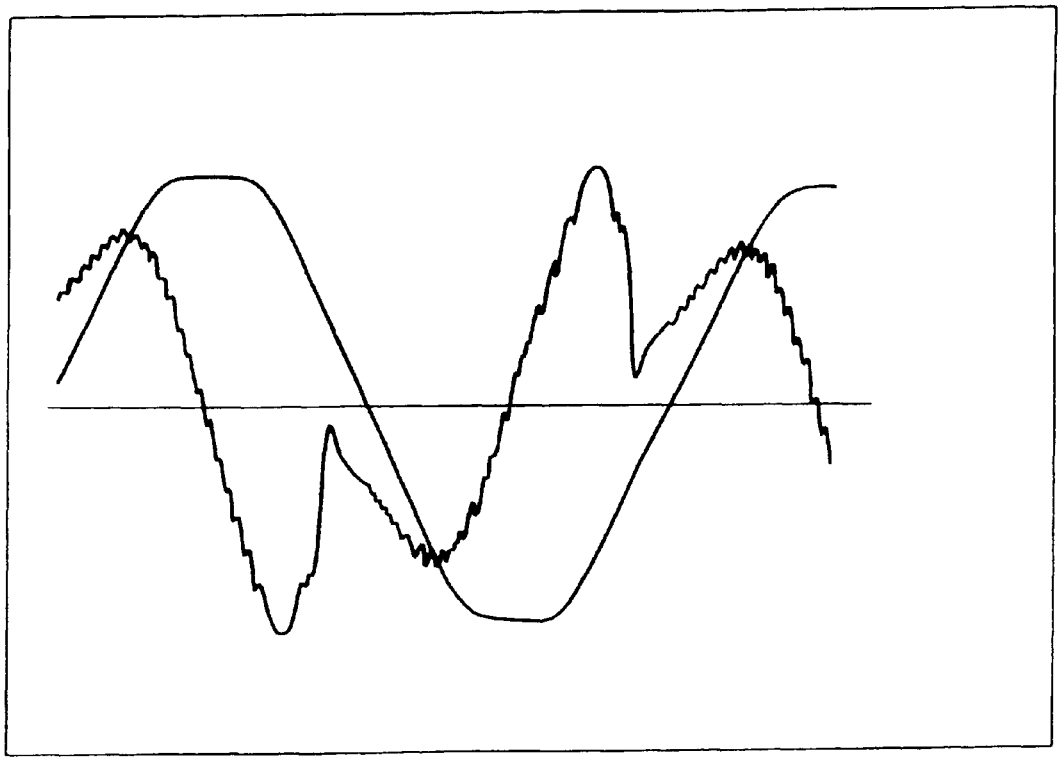
FIG. 12 is a view showing wave forms of voltage at ends of the choke coil upon start of lighting of a fluorescent lamp.
Figure 13:
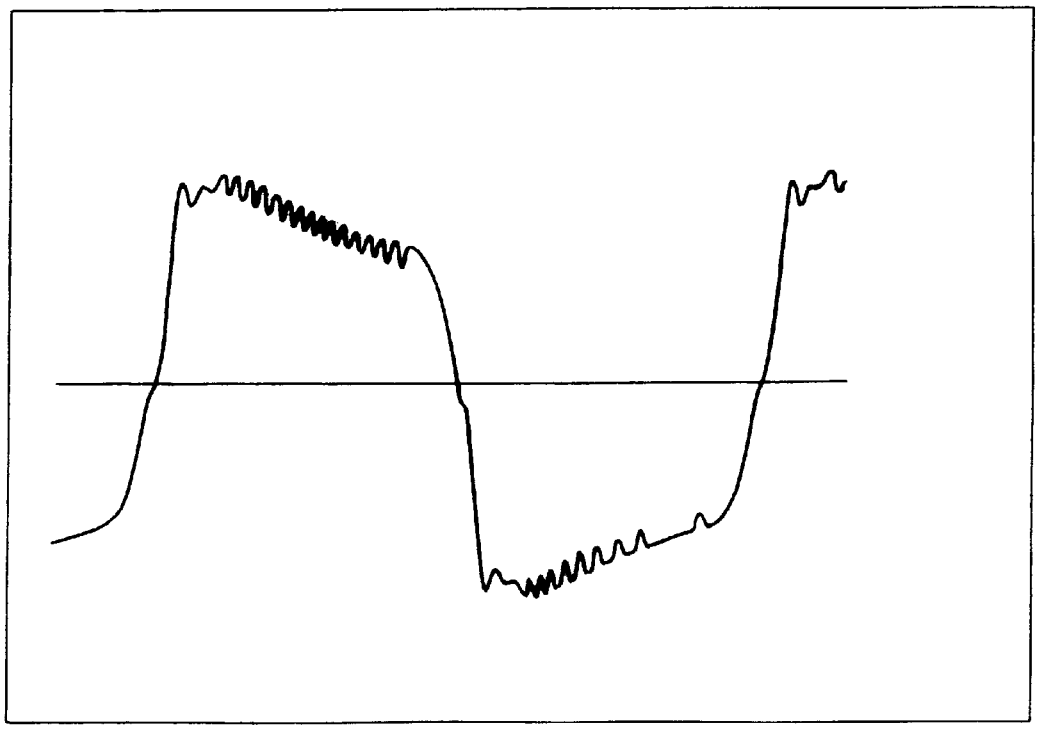
FIG. 13 is a view showing a wave form of discharge voltage upon lighting of the fluorescent lamp.

A discharge lamp lighting system according to a further embodiment of the present invention is shown in FIG. 8. In this embodiment, a starting lighting circuit is constituted by a relay R of self-holding type, an auxiliary choke coil $L_2$ and glow lamp G. The reason why two lamps are used is that two lamps can be lighted by the same copper loss as that of the single lamp. In this discharge lamp lighting system, current flows through a closed circuit including an AC power source AC, capacitor C, filament 2, contact 9 of the relay R, filament 3, next filament 3, contact 9, auxiliary choke coil $L_2$, filament 2 and choke coil L, so that the filaments 2, 3 are heated by the current. Then, the capacitor C and the choke coils $L+L_2$ are resonated to increase voltage of ends of the auxiliary choke coil $L_2$. Then, when the glow lamp G is operated to open the contact 9 of the relay R, the upper fluorescent lamp 1 in FIG. 8 is lighted by voltage generated at the ends of the auxiliary choke coil $L_2$. The lower fluorescent lamp 1 in FIG. 8 is lighted by the power source voltage and the lighting of the lamp is continued.

EFFECTS OF THE INVENTION

The discharge lamp lighting system according to the present invention achieves the following advantages.

1. Since any choke transformer is not used, the system can be constituted by the least number of parts, thereby making the system compact and light-weighted.
2. Since any choke transformer is not used, loss of the exciting current required for running the system and other loss such as iron loss due to magnetic history and heat loss of windings can almost be prevented, thereby greatly saving energy.
3. Since any choke transformer is not used, comparing input electric power and full luminous flux, energy saving effect of several tens of percents can be achieved in comparison with conventional fluorescent lamp lighting apparatuses.
4. Since the light emitting current is given when the commercial power source wave reaches the zero value, the light increasing effect is achieved to increase brightness of the fluorescent lamp. In one embodiment of the present invention, the light increasing effect is improved by about 30 percents.
5. Since the choke coil and the capacitor are provided, the flicker inherent to the fluorescent lamp can be prevented to substantially eliminate flickering of the fluorescent lamp. Incidentally, when a commercially available fluorescent lamp is lighted, in order to eliminate the flicker of the fluorescent lamp, excessive temporary saturated current for exciting substance has been used. However, in the present invention, excessive temporary saturated current is not required.
6. Since the both ends of the discharge lamp at which the high harmonic noise radio wave is generated are isolated from the power source circuit by the choke coil and the capacitor, the high harmonic noise radio wave is prevented from flowing into the power source circuit (power source system), thereby preventing erroneous operations of other electronic equipment or computers connected to the power source circuit and eliminating a bad influence of noise and/or radio-fault upon such equipment.
7. Since the choke coil and the capacitor, which are provided to resonate with a third high harmonic wave component, absorb the noise radio wave generated by negative charging property of the discharge lamp on the basis of the third high harmonic wave component of the power source to eliminate the noise peak wave component, erroneous operations of or bad influence upon other electronic equipment or computers connected to the power source circuit can be avoided.

What is claimed is:

1. A discharge lamp lighting system wherein:

one end of a discharge lamp is connected to one end of an alternating current power source through a capacitor and a choke coil which are interconnected in series, and an other end of said discharge lamp is connected to an other end of said alternating current power source through another choke coil in such a manner that a third high harmonic wave component of said power source resonates between an impedance ratio resonator formed by said capacitor and both said choke coils; and a starting circuit which is normally turned OFF and can be temporarily turned ON to light said discharge lamp is connected between filaments disposed at both ends of said discharge lamp.

2. A discharge lamp lighting system wherein:

one end of a discharge lamp is connected to one end of an alternating current power source through a capacitor and a choke coil which are interconnected in series, and an other end of said discharge lamp is connected to an other end of said alternating current power source through another choke coil, and wherein an impedance ratio between both said choke coils and said capacitor is in the range of 1:2 to 1:3; and a starting circuit which is normally turned OFF and can be temporarily turned ON to light said discharge lamp is connected between filaments disposed at both ends of said discharge lamp.

3. The discharge lamp lighting system according to claim 1, wherein said starting circuit comprises a switch.

4. The discharge lamp lighting system according to claim 2, wherein said starting circuit comprises a switch.

5. The discharge lamp lighting system according to claim 1, wherein said starting circuit includes an auxiliary choke coil and a glow lamp.

6. The discharge lamp lighting system according to claim 2, wherein said starting circuit includes an auxiliary choke coil and a glow lamp.

7. The discharge lamp lighting system according to claim 1, wherein said starting circuit includes an auxiliary choke coil, a glow lamp and a relay.

8. The discharge lamp lighting system according to claim 2, wherein said starting circuit includes an auxiliary choke coil, a glow lamp and a relay.

* * * * *